US006210207B1

(12) United States Patent
Kozel et al.

(10) Patent No.: US 6,210,207 B1
(45) Date of Patent: Apr. 3, 2001

(54) WIRE CLAMP, WIRE TRAP ELECTRICAL CONNECTOR

(75) Inventors: Charles A. Kozel, McHenry; John T. Scheitz, Barrington; Mark Stack, Streamwood, all of IL (US)

(73) Assignee: Method Electronics, Inc., Chicago, IL (US)

( * ) Notice: Subject to any disclaimer, the term of this patent is extended or adjusted under 35 U.S.C. 154(b) by 0 days.

(21) Appl. No.: 09/550,737

(22) Filed: Apr. 17, 2000

(51) Int. Cl.[7] ..... H01R 11/20
(52) U.S. Cl. ..... 439/438; 439/441; 439/835
(58) Field of Search ..... 439/438, 439, 439/441, 835

(56) References Cited

U.S. PATENT DOCUMENTS

| | | | | |
|---|---|---|---|---|
| 4,036,545 | * | 7/1977 | Mysiak et al. | 439/95 |
| 4,768,981 | * | 9/1988 | Hohorst | 439/835 |
| 5,494,456 | | 2/1996 | Kozel et al. | 439/441 |
| 5,915,991 | * | 6/1999 | Roman | 439/441 |
| 6,039,582 | | 3/2000 | Geis et al. | 439/76.1 |
| 6,056,585 | * | 5/2000 | Hatakeyama et al. | 439/441 |
| 6,074,242 | * | 6/2000 | Stefaniu et al. | 439/441 |

* cited by examiner

*Primary Examiner*—Hien Vu
*Assistant Examiner*—Ann McCamey

(74) *Attorney, Agent, or Firm*—Karl D. Kovach; David L. Newman

(57) ABSTRACT

An electrical connector including a wire clamp electrical connector portion and a wire trap electrical connector portion. The wire clamp portion includes a moving arm and a stationary arm where each arm has a respective contact end. An entrance exists between the contact ends. In an open position of the entrance of the wire clamp electrical connector portion, the contact ends are separated by a predetermined gap for receiving a conductor. The gap has a dimension which is greater than a diameter of a conductor. In a closed position of the entrance of the wire clamp electrical connector portion, contact ends are urged toward each other so as to contact and secure the conductor. The wire trap portion includes a moving arm and a stationary arm where the moving arm has a contact end and the stationary arm has a contact surface. An entrance exists between the contact end and the contact surface. In an open position of the entrance of the wire trap electrical connector portion, the contact end and the contact surface are separate by a predetermined gap so as to accept a conductor, where the conductor has a diameter greater than a dimension of the gap. In a closed position of the entrance of the wire trap electrical connector portion, the contact end and the contact surface are separated by a distance greater than the predetermined gap due to the introduction of the conductor into the entrance while the third contact end and the contact surface are urged toward each other so as to contact and secure the conductor.

6 Claims, 7 Drawing Sheets

Fig. 5
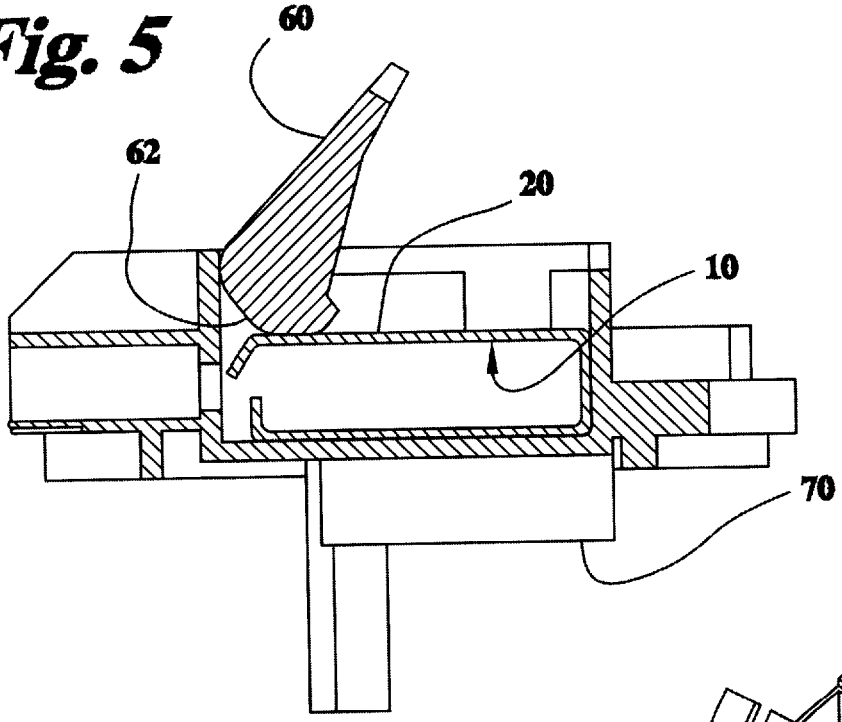
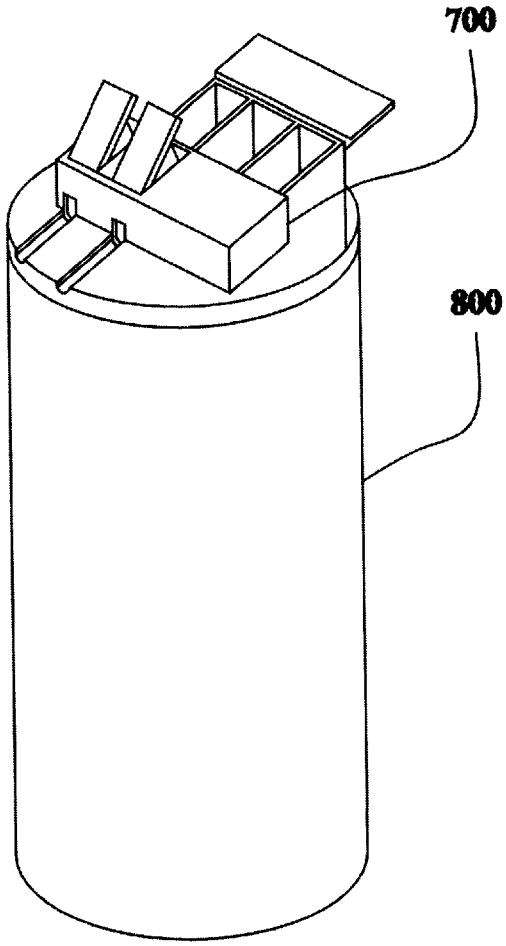
Fig. 6

WIRE CLAMP, WIRE TRAP ELECTRICAL CONNECTOR

BACKGROUND OF THE INVENTION

1. Field of the Invention

The present invention pertains to an electrical connector. The invention more particularly concerns an electrical connector having features of a wire clamp connector and a wire trap connector.

2. Discussion of the Background

For years now, competition in the electronics industry has forced contractors to keep material and labor costs at a minimum. Electrical devices and the associated labor required to install the electrical devices are components of the overall cost which must be reduced. The cost of electrical components can most easily be reduced by making them easier to assemble, thus reducing the associated labor cost component of the electrical device. Thus, labor costs are present throughout the assembly of the electrical device and the installation of the electrical device. Other cost are associated with the finished structure such as repair and replacement of electrical devices.

To facilitate the installation of printed circuit boards, printed circuit boards are known to have wire clamp or wire trap electrical connectors permanently mounted thereon. The wire clamp and wire trap electrical connectors have one end of their connectors soldered to traces of the printed circuit board, and the other end of their connectors receive external conductors so as to make an electrical connection between the external conductors and the traces on the printed circuit board.

The wire trap electrical connector works by pushing a conductor into an entrance of the wire trap electrical connector whereby the electrical connector "traps" the conductor between two opposing electrically conductive members and makes an electrical connection with the conductor. The conductor is press fitted between the two opposing members. Typically, only solid conductors are used in combination with a wire trap electrical connector since the conductor reacts a force along its length during insertion. During such an insertion, a cable made of stranded conductors may flatten out, thus loosing their circular cross-section as an assembly of stranded conductors and, hence, loose the electrical connection with the wire trap electrical connector.

Wire trap electrical connectors typically accept, at most, two different gauges of wire. Thus, the environment in which the wire trap electrical connector is assembled to another device must be a controlled environment. Such controlled environments exist at a factory where the housing which contains the wire trap electrical connector is attached to the device.

The wire clamp electrical connector works by inserting a conductor into an entrance which is larger than a diameter or thickness of the conductor, thus the conductor slides into the opening with little or no resistance. An external force is then applied to the wire clamp electrical connector so as to "clamp" the conductor between two opposing electrically conductive members of the wire clamp electrical connector thus making an electrical connection between the conductor and the wire clamp electrical connector. The wire clamp electrical connector accepts conductors which are solid as well as stranded conductors.

Unlike the wire trap electrical connector, the wire clamp electrical connector accepts many different gauges of conductors, where the conductors can be solid or stranded.

Thus, the wire clamp electrical connector can be used in an environment which is not very controlled. Such environments exist out in the field where a device containing the wire clamp electrical connector is connected to pre-existing conductors which the manufacturer of the device has no control over the size and type of conductor which is pre-existing.

Wire clamp and wire trap electrical connectors are used since they simplify the attachment of external conductors to printed circuit boards. Furthermore, the attachment of a conductor to a wire trap or a wire clamp electrical connector is repeatable. However, the attachment of wire trap and wire clamp electrical connectors to a printed circuit board are labor intensive, since the connectors are soldered in-place. Such attachment problems are present in the termination of other devices also. One of the most difficult termination applications is the termination of electrical conductors or traces present on devices which are wholly enclosed by a housing.

Therefore, there is a need for an electrical connector which is easy to make, easy to install, easy to use, and is inexpensive to produce and can fit in a small space.

SUMMARY OF THE INVENTION

Therefore, it is an object of the present invention to provide an electrical connector which securely connects to conductors of an enclosed electrical device while providing for reliable, repeatable, connection with conductors external to the housed electrical device.

It is still another object of the invention to provide an electrical connector incorporating aspects of a wire trap electrical connector and a wire clamp electrical connector.

Yet another object of the invention is to provide an electrical connector having a low profile.

It is a further object of the invention to provide an electrical connector which is easy to install.

It is still another object of the invention to provide an electrical connector which is easy to assemble.

Another object of the invention is to provide an electrical connector which is inexpensive to manufacture.

In one form of the invention, the wire clamp, wire trap electrical connector includes a wire clamp electrical connector portion and a wire trap electrical connector portion, where the wire trap electrical connector portion is attached to the wire clamp electrical connector portion.

In another form of the invention, the electrical connector includes a wire clamp electrical connector portion and a wire trap electrical connector portion where the wire clamp portion includes a moving arm and a stationary arm where each arm has a respective contact end. An entrance exists between the contact ends. In an open position of the entrance of the wire clamp electrical connector portion, the contact ends are separated by a predetermined gap for receiving a conductor. The gap has a dimension which is greater than a diameter of a conductor. In a closed position of the entrance of the wire clamp electrical connector portion, contact ends are urged toward each other so as to contact and secure the conductor. The wire trap portion includes a moving arm and a stationary arm where the moving arm has a contact end and the stationary arm has a contact surface. An entrance exists between the contact end and the contact surface. In an open position of the entrance of the wire trap electrical connector portion, the contact end and the contact surface are separate by a predetermined gap so as to accept a conductor, where the conductor has a diameter greater than a dimension of the gap. In a closed position of the entrance of the wire trap electrical connector portion, the contact end and the contact surface are separated by a distance greater than the predetermined gap due to the introduction of the conductor into the entrance while the contact end and the contact surface are urged towards each other so as to contact and secure the conductor.

In still yet another form of the invention, the wire clamp, wire trap electrical connector includes wire clamping means, and wire trapping means attached to the wire clamping means.

Thus, Applicants' invention is superior to existing devices or apparatuses for electrically connecting an external conductor to a conductor or trace of a device or printed circuit board. Applicants' invention provides an electrical connector which is small and inexpensive to produce, while at the same time being easy to manufacture, install, and use. These and other features of the invention are set forth below in the following detailed description of the presently preferred embodiments.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 5 is a side view of the wire clamp, wire trap electrical connector of FIG. 1 where a housing 70 substantially surrounds the wire clamp, wire trap electrical connector, wherein the housing has an activation lever for actuating the wire clamp electrical connector portion;

FIG. 6 is a perspective view of a housing and an electrical device joined with the housing where the housing secures a wire clamp, wire trap electrical connector;

DETAILED DESCRIPTION OF THE PRESENTLY PREFERRED EMBODIMENTS

Figure 1:
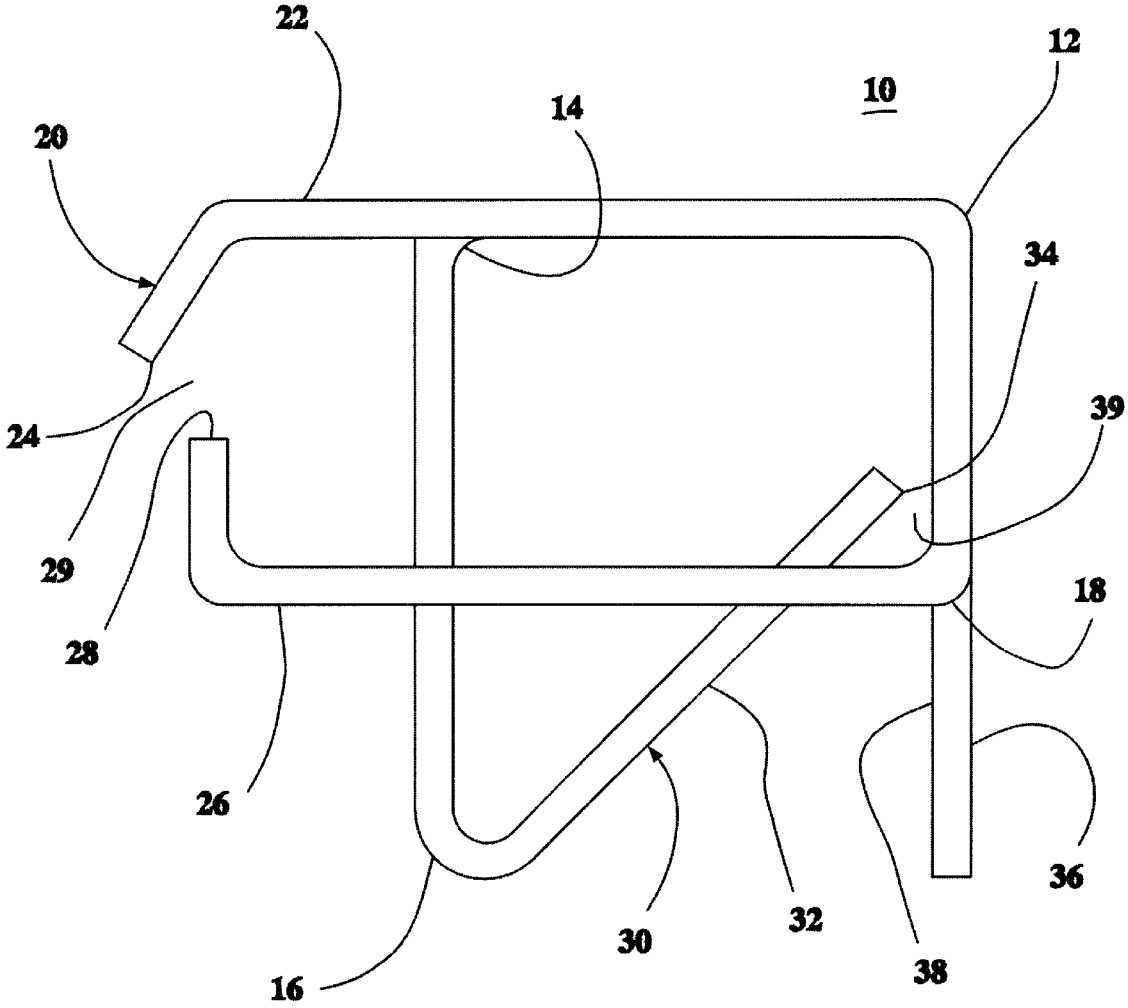
FIG. 1 is a side view of a wire clamp, wire trap electrical connector.

Referring now to the drawings, wherein like reference numerals designate identical or corresponding parts throughout the several views, and more particularly to FIGS. 1–4 thereof, a first embodiment of the present invention is a wire clamp, wire trap electrical connector 10.

FIG. 1 is a side view of the wire clamp, wire trap electrical connector 10. The wire clamp, wire trap electrical connector 10 includes a wire clamp electrical connector portion 20 and a wire trap electrical connector portion 30.

The wire clamp electrical connector portion 20 includes a moving arm 22 and a stationary arm 26. The moving arm 22 has a contact end 24 and the stationary arm 26 has a contact end 28. The contact end 24 of the moving arm 22 is separated from the contact end 28 of the stationary arm 26 by a gap or entrance 29.

The wire trap electrical connector portion 30 includes a moving arm 32 and a stationary arm 36. The moving arm 32 has a contact end 34 and the stationary arm 36 has a contact surface 38. The contact end 34 of the moving arm 32 is separated from the contact surface 38 of the stationary arm 36 by a gap or entrance 39.

In a preferred embodiment, the wire clamp, wire trap electrical connector 10 is formed from a single piece of metal. The wire trap electrical connector portion 20 being electrically connected to the wire clamp electrical connector portion 30 via ribs (not shown) which project into the plane of FIG. 1. Various bends 12, 14, 16, 18 illustrate the bending of the metallic material. The metallic material, once formed, has elastic material properties so as to allow the moving arms 22, 32 to deflect without experiencing permanent deformation. Additionally, the metallic material needs to have an acceptable fatigue life so as to enable the moving arms 22, 32 to deflect numerous times without breaking. Furthermore, the metallic material needs to have acceptable electrical conductivity characteristics.

The wire clamp, wire trap electrical connector 10 can also be constructed of other materials such as metallized plastic. The molded polymer body of such a material provides the needed elasticity, while the metallized outer coating provides the needed electrical conductivity.

Figure 2:
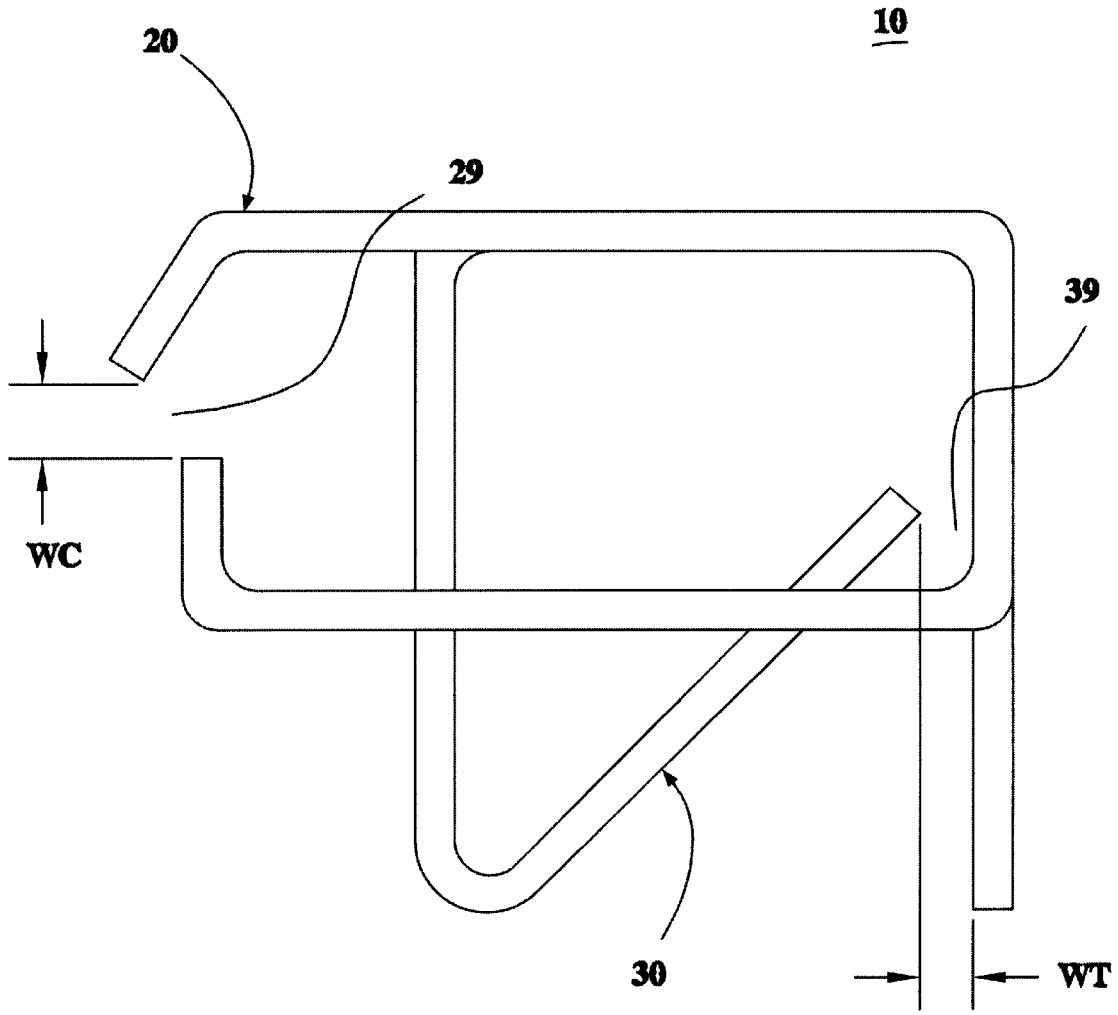
FIG. 2 is a side view of the wire clamp, wire trap electrical connector of FIG. 1 identifying the respective opening of each of the wire clamp electrical connector portion and the wire trap electrical connector portion.

FIG. 2 is a side view of the wire clamp, wire trap electrical connector 10, as in FIG. 1, which identifies a size dimension WC of the entrance 29 of the wire clamp electrical connector portion 20 and a size dimension WT of the entrance 39 of the wire trap electrical connector portion 30. FIG. 2 shows both the wire clamp electrical connector portion 20 and the wire trap electrical connector portion 30 in an open position.

Figure 3:
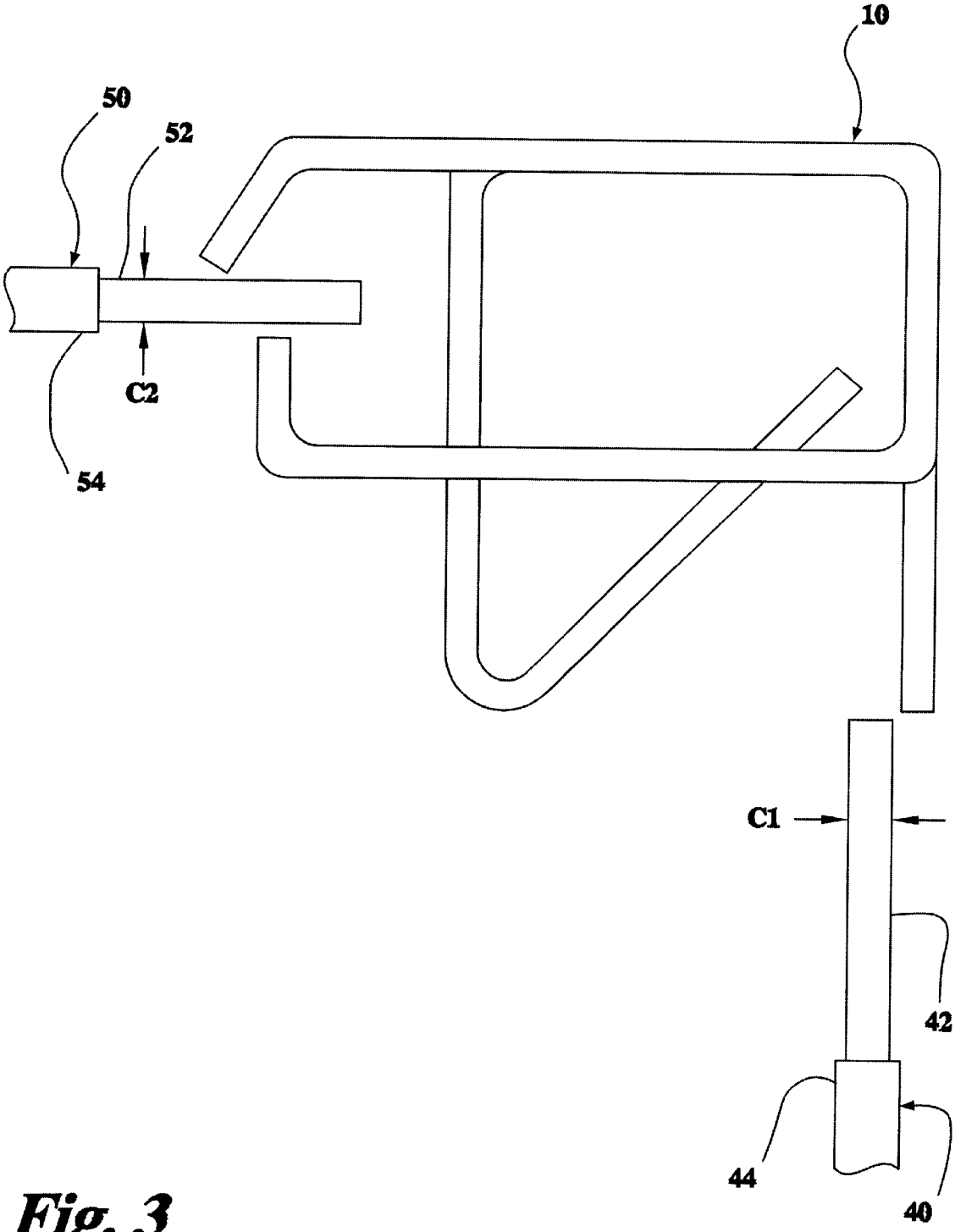
FIG. 3 is a side view of the wire clamp, wire trap electrical connector of FIG. 1 where conductors are introduced therein.

FIG. 3 is a side view of the wire clamp, wire trap electrical connector 10, as in FIG. 1, in combination with cables 40, 50. Cable 40 includes a conductor 42 and an insulative layer 44 covering a majority of the conductor's surface. Conductor 42 is typically a solid conductor. Conductor 42 has a size, diameter, thickness or width dimension identified as C1. Cable 50 includes a conductor 52 and an insulative layer 54 covering a majority of the conductor's surface. Conductor 52 can be a solid conductor or a stranded conductor. Conductor 52 has a size, diameter, thickness or width dimension identified as C2.

The size dimension C2 of conductor 52 is smaller than the size dimension WC of the entrance 29 of the wire clamp electrical connector portion 20. The size dimension C1 of the conductor 42 is larger than the size dimension WT of the entrance 39 of the wire trap electrical connector portion 30.

Figure 4:
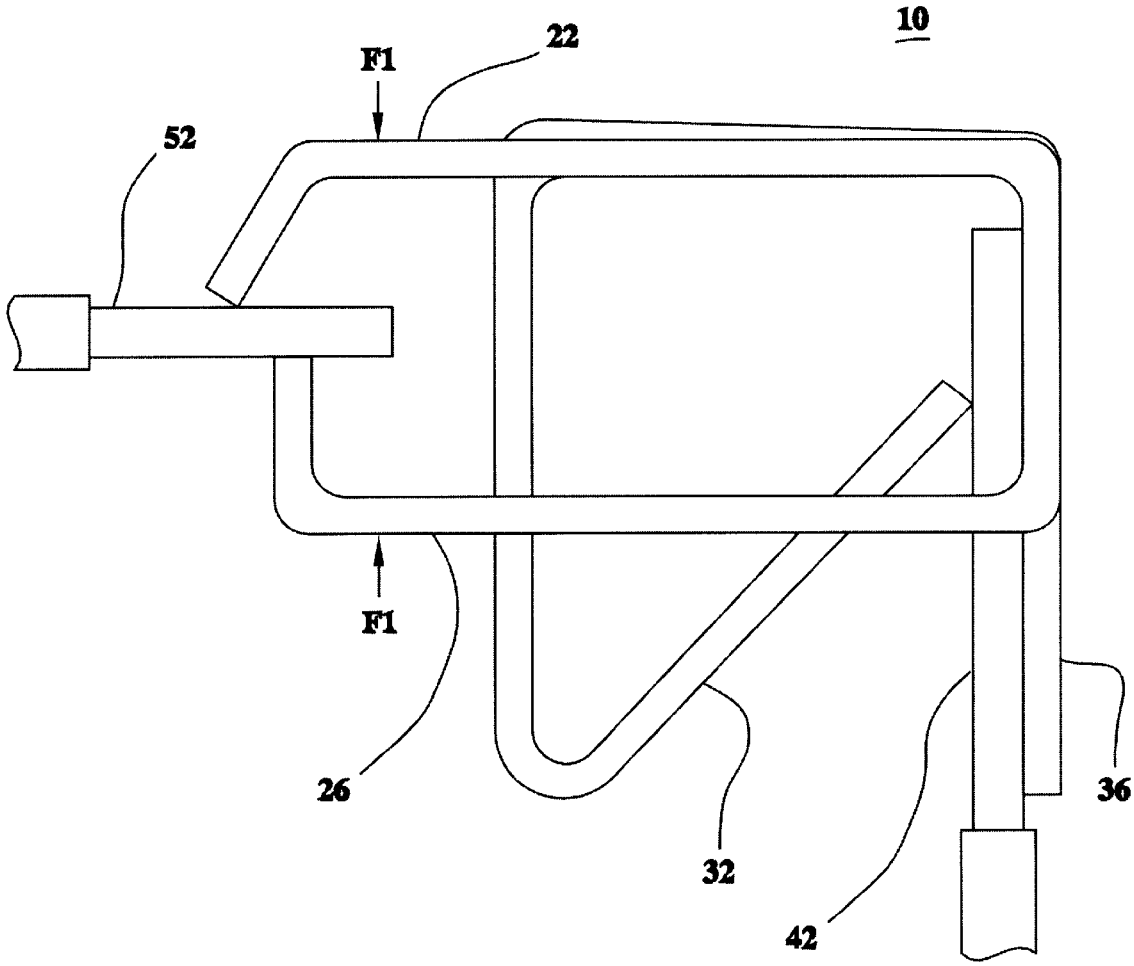
FIG. 4 is a side view of the wire clamp, wire trap electrical connector and conductors of FIG. 3 where the conductors are fully engaged therein.

FIG. 4 is a side view of the wire clamp, wire trap electrical connector 10 and conductors 42, 52 of FIG. 3, where the conductor 42 is fully engaged in the wire trap electrical connector portion 30 and the conductor 52 is fully engaged in the wire clamp electrical connector portion 20. FIG. 4 shows both the wire clamp electrical connector portion 20 and the wire trap electrical connector portion 30 in a closed position.

Conductor 52 is introduced into the wire clamp, wire trap electrical connector 10 at approximately ninety degrees to the introduction of conductor 42 into the wire clamp, wire trap electrical connector 10. Both conductors 42, 52 are introduced into the wire clamp, wire trap electrical connector 10 in a direction which parallels their respective longitudinal axes or directions. However, in other embodiments, the entrances of both the wire clamp electrical connector portion 20 and the wire trap electrical connector 30 can be oriented relative to each other at angles other than ninety degrees.

Since the width dimension C1 of conductor 42 is greater than the gap dimension WT of the entrance 39, the conductor 42 causes the moving arm 32 of the wire trap electrical connector portion 30 to elastically move in a direction away from the stationary arm 36 as the conductor 42 is introduced therein. Furthermore, the conductor 42 is easily introduced into the entrance 39 since the moving arm 32 and the stationary arm 36 form a vertex or funnel type of shape. Once fully inserted into the wire trap electrical connector portion 30, the conductor 42 is trapped between the contact end 34 of the moving arm 32 and the contact surface 38 of the stationary arm 36. Since the moving arm 32 is deflected, it applies a force to the conductor 42 and urges the conductor 42 toward the stationary arm 36. Thus, the wire trap electrical connector portion 30 is in electrical contact with the conductor 42 via either one or both of the contact end 34 and the contact surface 38.

To detach conductor 42 from the wire trap electrical connector portion 30, a tool (not shown) can be pressed against the moving arm 32 so as lift the contact end 34 off of the surface of the conductor 42 thus forming a disengagement gap which is larger than the thickness of the conductor 42. Then, the conductor 42 can be pulled out of the entrance 39. To prevent the moving arm 32 from being deflected too far, and hence be overstressed, when the tool is pressed against it, a housing in which the wire trap electrical connector portion 30 is housed can have features which prevent the moving arm 32 from deflecting too far. Such an anti-overstress features are disclosed in U.S. patent application Ser. No. 09/224,611. U.S. patent application Ser. No. 09/224,611 is hereby incorporated herein by reference.

Since the width dimension C2 is less than the gap dimension WC of the entrance 29 of the wire clamp electrical connector portion 20, an external force F1 must be applied to the moving arm 22 and reacted out of the stationary arm 26 so as to clamp the conductor 52 between the contact end 24 of the moving arm 22 and the contact end 28 of the stationary arm 26. The external force F1 can be applied by hand, machine, gravity, electromagnetism, fluid pressure, etc. The external force F1 ensures that electrical contact is achieved between the conductor 52 and either one or both of the contact end 24 of the moving arm 22 and the contact end 28 of the stationary arm 26. Thus, conductor 52 is in electrical contact with conductor 42 via the wire clamp, wire trap electrical connector 10.

To detach conductor 52 from the wire clamp electrical connector portion 20, the external force F1 must be removed. Upon removal of the external force F1, the moving arm 22 returns to its undeflected or free state position due to its elasticity. Conductor 52 can then be pulled out of the entrance 29.

The stationary arms 26, 36 remain stationary since they are constrained from moving. The stationary arms 26, 36 are constrained from moving since the wire clamp, wire trap electrical connector 10 is, typically, housed in an insulative shell, body, or housing.

FIG. 5 is a side view of the wire clamp, wire trap electrical connector 10 positioned within a housing 70. Only the wire clamp electrical connector portion 20 is visible. The housing 70 includes an activation lever 60 pivotally mounted thereto. The lever 60 includes a cammed surface 62. The cammed surface 62 slides against a surface of the moving arm 22. In use conductor 52 is introduced into the entrance 29 of the wire clamp electrical connector portion 20, then the activation lever 60 is rotated so that the cammed surface 62 pushes a portion of the moving arm 22 toward the stationary arm 26 so as to clamp the conductor 52 between the contact ends 24, 28. To release the conductor 52, the activation lever 60 is rotated in an opposite direction which removes the cam action of the cammed surface 62 from the surface of the moving arm 22. Then, the moving arm 22 returns to its free state position since it is not being acted upon by an external force.

FIG. 6 is a perspective view of a housing 700 joined with an electrical device 800. The housing 700 secures a wire clamp, wire trap electrical connector (not shown) therein. In such an embodiment, the wire trap electrical connector portion accepts an internal conductor positioned within the electrical device. The environment in which the wire trap electrical connector portion connects to the internal conductor is controlled. The internal conductor has a known gauge size. The wire trap electrical connector portion traps the internal conductor in a factory floor environment. Then, the wire trap electrical portion is used to connect with an external conductor. The external conductor is out in the field, a field installation. The manufacturer of the combined housing 700 and device 800 has no control over the type and gauge size of the external conductor. This embodiment is well suited to the invention, since the wire trap electrical connector portion can be blindly and permanently connected to the internal conductor, while the wire clamp electrical connector portion can be repeatedly clamped on and off of the external connector.

In the past, a device similar to device 800 would have two insulated conductors extending out of the housing of the device. In the field, the laborer would strip the insulation off of the conductors of the device and also strip insulation off of the conductors to which the conductors of the device are to be connected. The laborer would then join the appropriate conductors by spinning a wire nut on the exposed conductors. Now, with the use of the wire clamp, wire trap electrical connector, the laborer merely strips the insulation away from the field conductors, inserts the field conductors into the wire clamp electrical connector portion of the wire clamp, wire trap electrical connector, and rotates the lever to lock the field conductors in-place.

Figure 7:
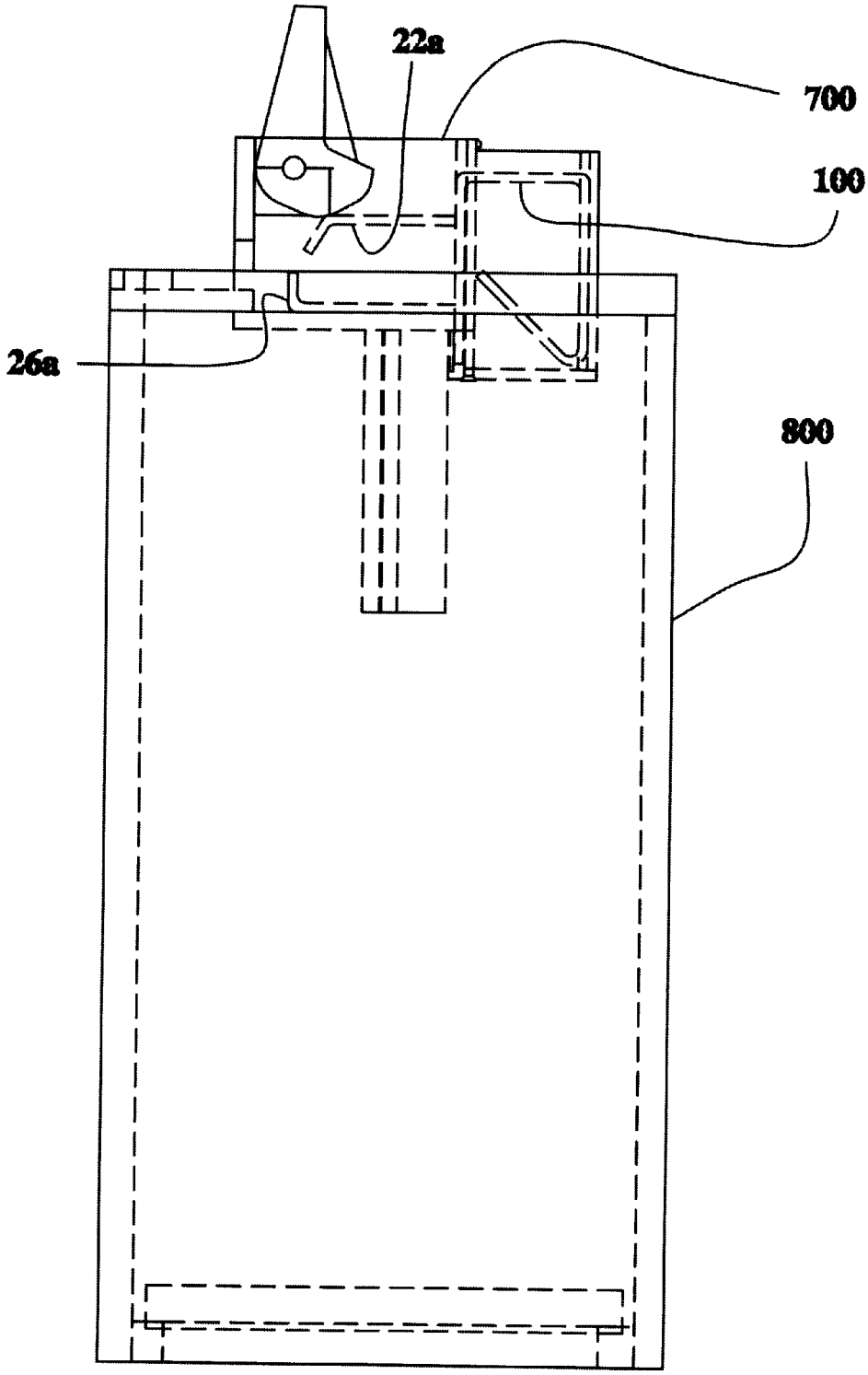
FIG. 7 is a side view of the housing and electrical device of FIG. 6 where internal features are shown in phantom line.

FIG. 7 is a side view of the housing 700 and the electrical device 800 of FIG. 6. Internal features of an embodiment of the wire clamp, wire trap electrical connector 100 are shown in phantom line. Note that the vertex or funnel of the wire trap electrical connector portion is oriented differently than the way it is positioned in FIG. 1 relative to the wire clamp electrical connector portion. Furthermore, also as different from FIG. 1, the stationary arm 26*a* of the wire clamp electrical connector portion extends farther away from the wire trap electrical connector portion than does the moving arm 22*a*.

Figure 8:
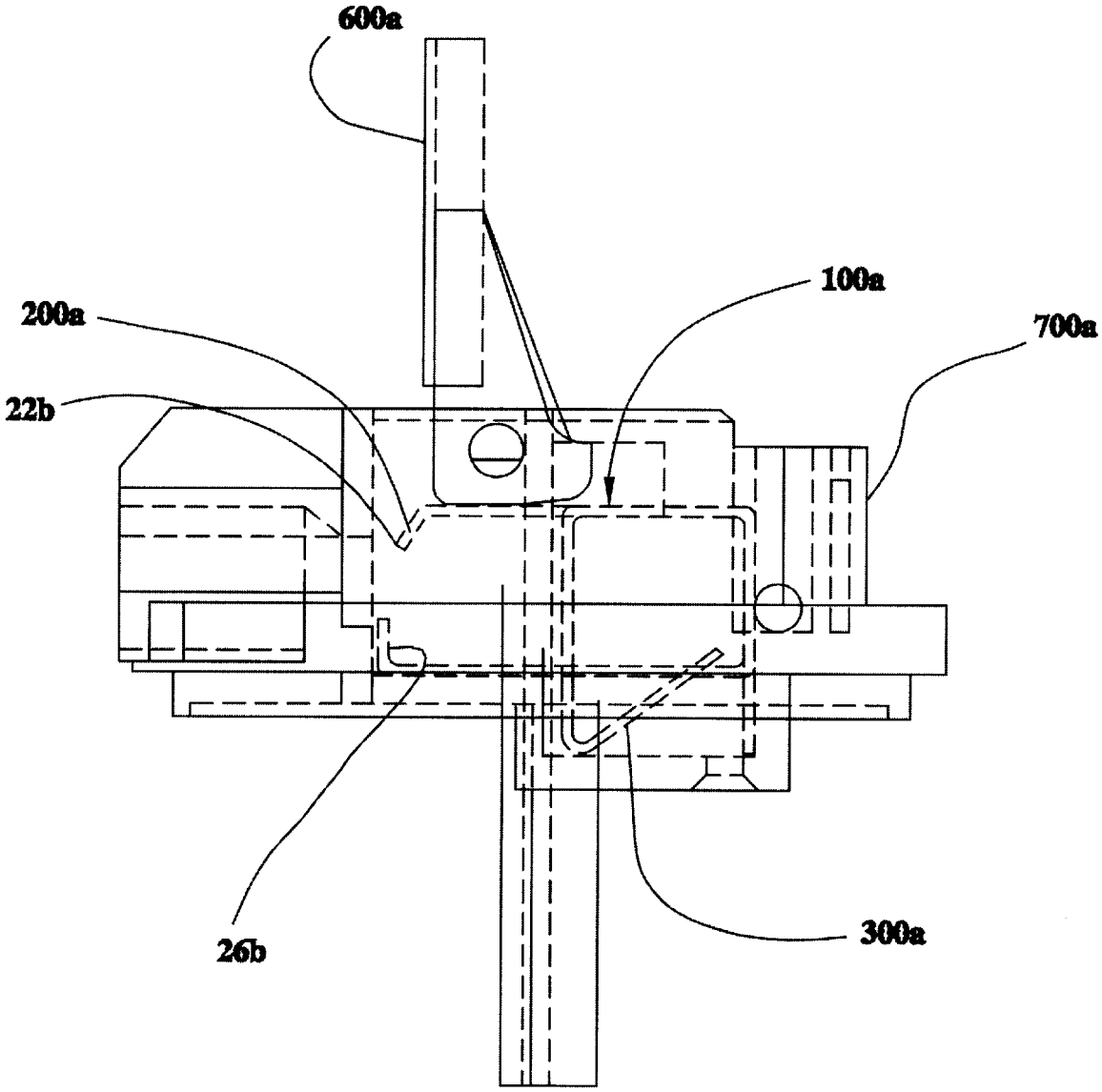
FIG. 8 is a side view of another embodiment of the wire clamp, wire trap electrical connector shown in phantom line.

FIG. 8 is a side view of another embodiment of the wire clamp, wire trap electrical connector 100*a* positioned in a housing 700*a*, which is similar to the connector 10 displayed in FIG. 5. However, in this embodiment the stationary arm 26*b* extends farther from the wire trap electrical connector portion 300*a* than does the moving arm 22*b*. The housing 700*a* includes an activation lever 600*a* which has a cammed surface. The wire clamp electrical connector portion 200*a* and the wire trap electrical connector portion 300*a* of the wire clamp, wire electrical connector 100*a* are clearly shown in phantom line.

In another embodiment, the stationary arms 26, 36 can move and the moving arms 22, 32 can be stationary. In still another variation of the invention, all of the stationary arms 26, 36 and the moving arms 22, 32 can move.

In still another embodiment, the wire clamp, wire trap electrical connector can include one wire clamp electrical connector portion attached to two wire trap electrical connector portions.

In still yet another embodiment, the wire clamp, wire trap electrical connector can include one wire trap electrical connector portion attached to two wire clamp electrical connector portions.

Obviously, numerous modifications and variations of the present invention are possible in light of the above teachings. It is therefore to be understood that within the scope of the appended claims, the invention may be practiced otherwise than as specifically described herein.

What is claimed is:

1. A wire clamp, wire trap electrical connector comprising:

a wire clamp electrical connector portion including a moving arm and a stationary arm, the moving arm having a first contact end, and the stationary arm having a second contact end, the wire clamp electrical connector portion including an entrance of the wire clamp electrical connector portion formed between the first contact end and the second contact end, and wherein in an open position of the entrance of the wire clamp electrical connector portion, the first contact end and the second contact end are separated by a second predetermined gap so as to accept therein a second conductor, and wherein the second predetermined gap has a dimension greater than a thickness of the second conductor, and wherein, in a closed position of the entrance of the wire clamp electrical connector portion, the first contact end and the second end are urged toward each other so as to contact and secure the second conductor therebetween, and wherein the second conductor does not have insulation material applied thereto; and a wire trap electrical connector portion attached to the wire clamp electrical connector portion, the wire trap electrical connector portion including a moving arm and a stationary arm, the moving arm includes a third end, and the stationary arm includes a contact surface, the wire trap connector portion including an entrance of the wire trap electrical connector portion formed between the third contact end and the contact surface, and wherein, in an open position of the entrance of the wire trap electrical connector portion, the third contact end and the contact surface are separated by a first predetermined gap so as to accept therein a first conductor, and wherein the first conductor has a thickness greater than a dimension of the first predetermined gap, and wherein, in a closed position of the entrance of the wire trap electrical connector portion, the third contact end and the contact surface are separated by a distance greater than the first predetermined gap due to the introduction of the first conductor into the entrance while the third contact end and the contact surface are urged toward each other so as to contact and secure the first conductor therebetween, and wherein the first conductor does not have insulation material applied thereto, and wherein the first conductor has a longitudinal dimension in a longitudinal direction, the first conductor introduced into the entrance of the wire trap electrical connector portion in the longitudinal direction of the longitudinal dimension of the first conductor, and wherein the second conductor has a longitudinal dimension in a longitudinal direction, the second conductor introduced into the entrance of the wire clamp electrical portion in the longitudinal direction of the longitudinal dimension of the second conductor, and wherein the longitudinal direction of the first conductor is oriented substantially ninety degrees to the longitudinal direction of the second conductor, and wherein the stationary arm of the wire clamp electrical connector portion has a longitudinal dimension in a longitudinal direction, and wherein the longitudinal direction of the longitudinal dimension of the stationary arm of the wire clamp electrical connector is oriented substantially parallel to the longitudinal direction of the longitudinal dimension of the second conductor.

2. The wire clamp, wire trap electrical connector according to claim 1 further comprising a conductive outer surface of the wire clamp, wire trap electrical connector.

3. The wire clamp, wire trap electrical connector according to claim 1 wherein the wire clamp, wire trap electrical connector is made of an electrically conductive material.

4. The wire clamp, wire trap electrical connector according to claim 3 wherein the wire clamp, wire trap electrical connector is made of a metallic material.

5. The wire clamp, wire trap electrical connector according to claim 1 wherein, in the closed position of the wire trap electrical connector portion, the third contact end prevents the first conductor from being disengaged from the wire trap electrical connector portion without the assistance of a tool providing a force to deflect the moving arm of the wire trap electrical connector portion away from the stationary arm of the wire trap electrical connector portion so as to create a disengagement gap which is larger than the thickness of the first conductor.

6. The wire clamp, wire trap electrical connector according to claim 5 wherein the stationary arm of the wire trap electrical connector portion has a longitudinal dimension in a longitudinal direction, and wherein the longitudinal direction of the longitudinal dimension of the stationary arm of the wire trap electrical connector is oriented substantially ninety degrees to the longitudinal direction of the longitudinal dimension of the stationary arm of the wire clamp electrical connector.

* * * * *